US007020403B2

(12) United States Patent
Nomura

(10) Patent No.: US 7,020,403 B2
(45) Date of Patent: Mar. 28, 2006

(54) IMAGE FORMING APPARATUS ACHIEVING REDUCTION IN POWER CONSUMPTION

(75) Inventor: Takeshi Nomura, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 85 days.

(21) Appl. No.: 10/762,545

(22) Filed: Jan. 23, 2004

(65) Prior Publication Data

US 2004/0151513 A1 Aug. 5, 2004

(30) Foreign Application Priority Data

Jan. 29, 2003 (JP) ..... 2003-020204

(51) Int. Cl.
*G03G 15/00* (2006.01)

(52) U.S. Cl. ..... 399/8; 399/9; 399/88

(58) Field of Classification Search ..... 399/8, 399/9, 37, 88, 90
See application file for complete search history.

(56) References Cited

U.S. PATENT DOCUMENTS

| | | | | |
|---|---|---|---|---|
| 5,293,196 | A | 3/1994 | Kaneko et al. | |
| 5,335,048 | A * | 8/1994 | Takano et al. | 399/8 |
| 5,512,979 | A * | 4/1996 | Ogura | 399/8 |
| 5,543,892 | A | 8/1996 | Hirata et al. | |
| 5,995,771 | A * | 11/1999 | Miyawaki | 399/8 |
| 6,717,693 | B1 * | 4/2004 | Mitsuhashi et al. | 399/8 |

FOREIGN PATENT DOCUMENTS

JP 11-27439 1/1999

* cited by examiner

*Primary Examiner*—Sandra L. Brase
(74) *Attorney, Agent, or Firm*—Buchanan Ingersoll PC

(57) ABSTRACT

An image forming apparatus includes a power supply that is not turned off even in power saving mode. The power supply continues to supply electric power to one or more sensors detecting the status of the apparatus and to an interface with a network. Thus, while power supply to such loads as a scanner unit, an image processing unit and a printing unit is turned off, respective sensor values in the image forming apparatus can be reported to an external communication terminal.

20 Claims, 8 Drawing Sheets

| IMAGE FORMING APPARATUS | | I | II | III | IV |
|---|---|---|---|---|---|
| MIB INFORMATION | RECOVERY TIME | 90 sec | 60 sec | 0 sec | 0 sec |
| | PRINTING SPEED | 50 sheets /min | 50 sheets /min | 20 sheets /min | 5 sheets /min |
| | FIRST PRINT TIME | 20 sec | 20 sec | 10 sec | 8 sec |
| | REMAINING PAPER AMOUNT | 500 sheets | 20 sheets | 200 sheets | 10 sheets |
| JOB FINISH TIME | | 230 sec | 200 sec | 250 sec | 1208 sec |

IMAGE FORMING APPARATUS ACHIEVING REDUCTION IN POWER CONSUMPTION

This application is based on Japanese Patent Application No. 2003-20204 filed with Japan Patent Office on Jan. 29, 2003, the entire content of which is hereby incorporated by reference.

BACKGROUND OF THE INVENTION

1. Field of the Invention

The present invention relates to an image forming apparatus. In particular, the present invention relates to an image forming apparatus connected to a network and having power-supply control for power saving mode by which power consumption is reduced.

2. Description of the Related Art

As a printing technique, it has been known to transmit data (job) from a communication terminal (e.g. personal computer or PC) to one of a plurality of image forming apparatuses (e.g. printers, facsimile machines, multifunction peripherals) connected on a network so as to produce prints.

In such a case that a user on the network sends from the communication terminal an instruction to make prints, it is often desirable to select and use, from the image forming apparatuses on the network, an image forming apparatus that can produce and provide prints in the shortest period of time.

In order to select such an image forming apparatus, information is necessary as to whether or not the image forming apparatuses are each ready to make prints and whether or not there remain sufficient supplies, for example, paper. Then, a management information base (MIB) can be used for obtaining such information.

Regarding a power-saving structure of a facsimile machine, Japanese Laid-Open Patent Publication No. 11-27439 discloses a technique according to which supply of electric power to a block including a transfer unit, a scanner unit and a fan motor unit is shut off in power saving mode and a CPU detects any change of paper or a toner for example by a user.

If the technique disclosed in Japanese Laid-Open Patent Publication No. 11-27439 is employed, a problem arises that conditions of the image forming apparatus cannot be known via the network in power saving mode and thus it cannot be known when the image forming apparatus will be ready again to operate.

A management device has also been known that informs a service center of the status of an image forming apparatus via a network.

This type of management device immediately informs the service center of any trouble when it occurs in the image forming apparatus and then operates to shorten, as much as possible, the period in which the image forming apparatus is out of order. However, the image forming apparatus in power saving mode cannot inform the service center of status values or troubles for example. Therefore, the known techniques cannot provide immediate services addressing any trouble occurring in power saving mode.

SUMMARY OF THE INVENTION

The present invention has been made to solve the above-described problems, and an object of the invention is to provide an image forming apparatus without interference with use of the apparatus.

In order to achieve the object above, according to an aspect of the present invention, an image forming apparatus includes a printer forming an image on a printing medium, a first power supply supplying electric power to the printer, an interface communicating with an external communication terminal, a detector detecting a change in status in the image forming apparatus, a second power supply supplying electric power to the interface and the detector, and a controller. The controller is provided to control the first power supply and the second power supply. While the first power supply is turned off and the second power supply is turned on, the controller transmits a result of detection by the detector to the communication terminal via a network.

According to another aspect of the present invention, an image forming apparatus includes a printer forming an image on a printing medium, a first power supply supplying electric power to the printer, an interface communicating with an external communication terminal, a detector detecting a change in status in the image forming apparatus, a third power supply supplying electric power to the detector, a fourth power supply supplying electric power to the interface, and a controller. The controller is provided to control the first power supply, the third power supply and the fourth power supply. While the first power supply and the third power supply are turned off and the fourth power supply is turned on, the controller turns on the third power supply upon request from the communication terminal.

According to still another aspect of the present invention, a method of controlling an image forming apparatus is provided. The image forming apparatus includes a printer forming an image on a printing medium, a first power supply supplying electric power to the printer, an interface communicating with an external communication terminal, a detector detecting a change in status in the image forming apparatus, a second power supply supplying electric power to the interface and the detector, and a controller controlling the first power supply and the second power supply. The method includes a power-supply control step of making a transition of the first power supply from a turned-on state to a turned-off state, a detection step of detecting by the detector a change in status in the image forming apparatus, and a transmission step of transmitting a result of detection to the communication terminal.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[First Embodiment]

Figure 1:
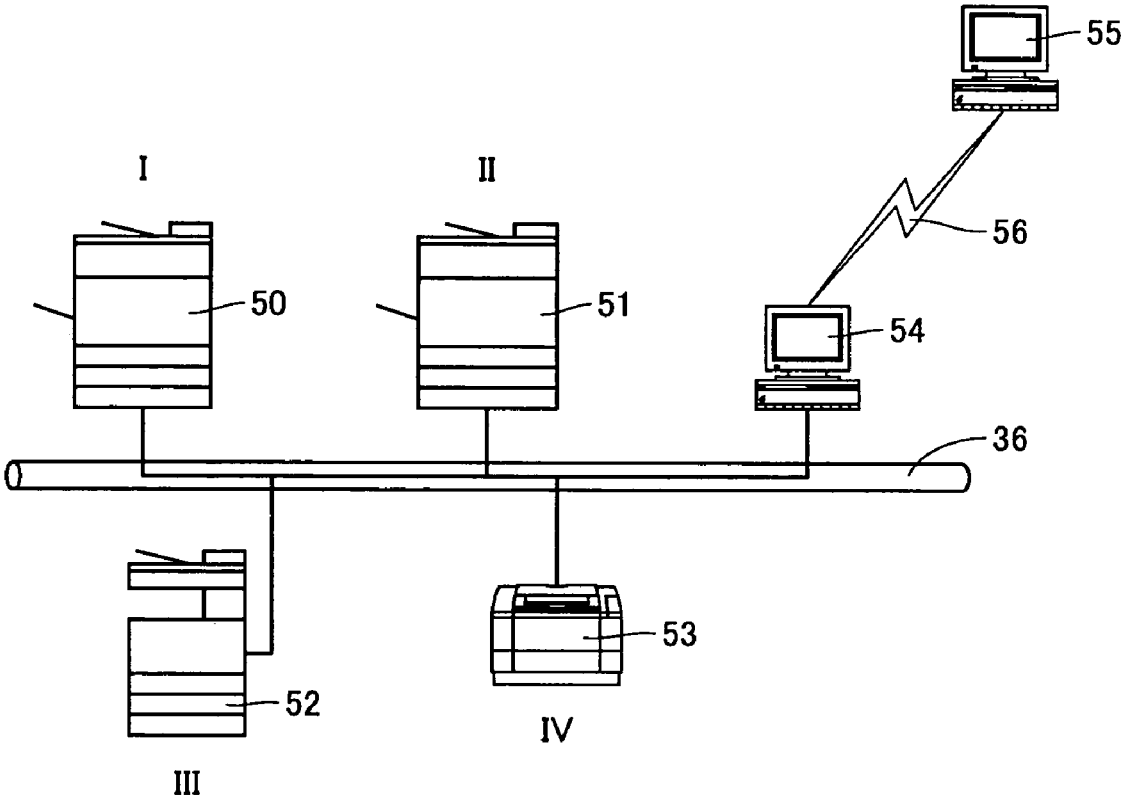
FIG. 1 shows a network to which a plurality of image forming apparatuses are connected according to a first embodiment of the present invention.

Referring to FIG. 1, a plurality of image forming apparatuses 50, 51, 52 and 53 and a communication terminal 54, which is for example a server, are connected on a network 36. When image forming apparatuses 50, 51, 52 and 53 each receive a print job via network 36 from communication terminal 54, a power supply in image forming apparatuses 50, 51, 52 and 53 each is turned on so that printing is started.

Here, communication terminal 54 has a function, using its capability of communicating with each of image forming apparatuses 50, 51, 52 and 53, of selecting one of image forming apparatuses 50, 51, 52 and 53 for producing prints, as well as a function, using its capability of connecting to the Internet via a telephone line 56 for example, of communicating with a personal computer (PC) 55 of a service center via the Internet.

Communication terminal 54 may function as a print server. In this case, a print job is transmitted from another communication terminal (not shown).

For example, if a malfunction of image forming apparatus 50 is detected by a sensor, this information obtained by the sensor is reported to the service center via communication terminal 54 and then a service person is dispatched to immediately perform maintenance.

Image forming apparatuses 50, 51, 52 and 53 each have MIB information that provides various types of data such as data about the configuration of the apparatus, data about the status thereof and data necessary for establishing an interface with communication terminal 54. The MIB information is assembled from status data pieces obtained respectively by functional blocks within the image forming apparatus. These data pieces are collected at an interface unit 7 (see FIG. 2) through communication lines between respective functional blocks. The MIB information also provides materials for allowing communication terminal 54 to select one of the image forming apparatuses, for example, recovery time to be taken from the time of exit from power saving mode to the time when the apparatus is ready to make prints, printing speed, first print time to be taken for producing a first print, remaining amount of paper, and finish time of a current job.

Figure 2:
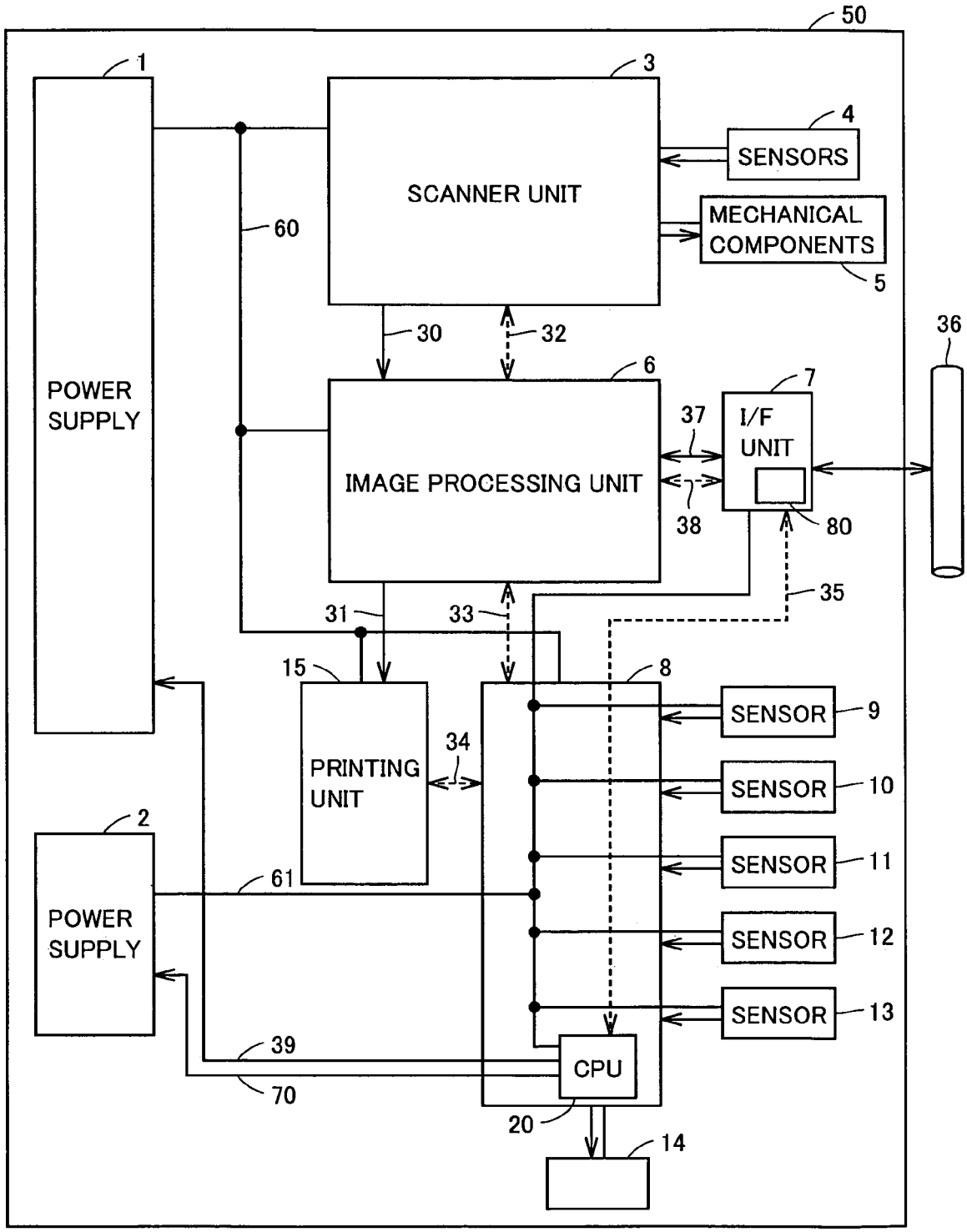
FIG. 2 is a block diagram showing a configuration of one of the image forming apparatuses in FIG. 1.

FIG. 2 is a block diagram showing a configuration of one of the image forming apparatuses in FIG. 1. Here, image forming apparatus 50 is representatively shown.

Referring to FIG. 2, a scanner unit 3 is a block by which an original document is read in. This block has its input ports to which respective results of detections by many sensors 4 such as a document detection sensor and the like are input. The block also has its output ports to which many mechanical components 5 such as a scan motor, a document feed motor and the like are connected. Scanner unit 3 controls mechanical components 5 based on information from sensors 4 and operates to feed and read a document. Read image data is transferred via a data bus 30 to an image processing unit 6.

Image processing unit 6 is a block of processing, in various ways, the image data transferred from scanner unit 3 or image data transferred from interface unit 7. Specifically, this block performs scaling-up, scaling-down, rotation and coupling, for example, on the image data transferred thereto.

The image data processed by image processing unit 6 is transferred via an image bus 31 to a printing unit 15. Printing unit 15 forms a latent image of the image data on a photoreceptor by means of a laser scan system or the like to perform an image-forming operation through a xerography process, by producing a toner image, transferring the image to a sheet of print paper and fixing the image thereto.

A printer block 8 is a block of controlling the operation of the xerography process as described above. This block has its input ports to which respective values detected by a plurality of sensors 9, 10, 11, 12 and 13 that are necessary for the xerography process are input. Sensors 9, 10, 11, 12 and 13 detect changes in status of the image forming apparatus, and are specifically fusing roller temperature sensor 9, paper stock detection sensor 10 detecting the remaining amount of paper stocked in a paper cassette, photoreceptor temperature sensor 11, paper moisture detection sensor 12, and transport-system-related sensor (hereinafter transport sensor) 13 placed on a paper transport path.

Fusing roller temperature sensor 9 is, for example, a thermistor detecting the temperature of a fusing roller.

Paper stock detection sensor 10 is, for example, a potentiometer.

Photoreceptor temperature sensor 11 is such a temperature sensor as a thermistor for detecting a change in sensitivity of the photoreceptor. The sensitivity of the photoreceptor relates to a temperature change and accordingly a change in temperature is usually detected for detecting a change in sensitivity.

Paper moisture detection sensor 12 is, for example, a ceramic moisture-sensitive element detecting the moisture of print paper.

Transport sensor 13 is, for example, a photocoupler detecting where a sheet of paper is transported, specifically, whether a sheet of print paper is present or not.

Printer block 8 includes a CPU 20 having its output ports to which connected components 14, namely such mechanical components as paper-transport-related motor and clutch and motors for driving the photoreceptor and the fusing roller as well as such control components as an ON/OFF switch of a fusing heater and an ON/OFF switch of a dehumidifier heater for a paper cassette.

CPU 20 controls the mechanical components and the switches based on respective results of detection by the sensors to transport paper and form an image. Further, CPU 20 detects a value indicated by photoreceptor temperature sensor 11 to perform image stabilization if a temperature change occurs that is greater than a predetermined temperature difference, and detects the temperature of the fusing roller indicated by fusing roller temperature sensor 9 to control ON and OFF of the fusing heater for keeping a constant temperature of the roller surface.

Moreover, CPU 20 performs power-saving control by turning on and turning off power supply.

Interface unit 7 is a block of receiving data from network 36 like Ethernet (R) or transferring image data read by scanner unit 3 to network 36. Interface unit 7 obtains Management Information Base (MIB) information from each of blocks 3 and 6 and printer block 8 and stores the obtained information in its internal storage unit 80.

CPU 20 starts clocking when power supply to other blocks is turned off to calculate values of the MIB information to be transmitted to network 36. Interface unit 7 transmits, in response to a request for MIB information from network 36, the MIB information stored therein to network 36. The interface unit 7 and the image processing unit 6 are connected by a line 38 and a line 37.

Scanner unit 3 and image processing unit 6 are connected by a communication line 32. Image processing unit 6 and printer block 8 are connected by a communication line 33. Printer block 8 and printing unit 15 are connected by a communication line 34. In this way, the blocks adjust respective timings with respect to each other to perform successive operations of image reading, image processing and image forming. Moreover, the blocks perform respective operations of image processing and image forming on image data from network 36.

Figure 3:
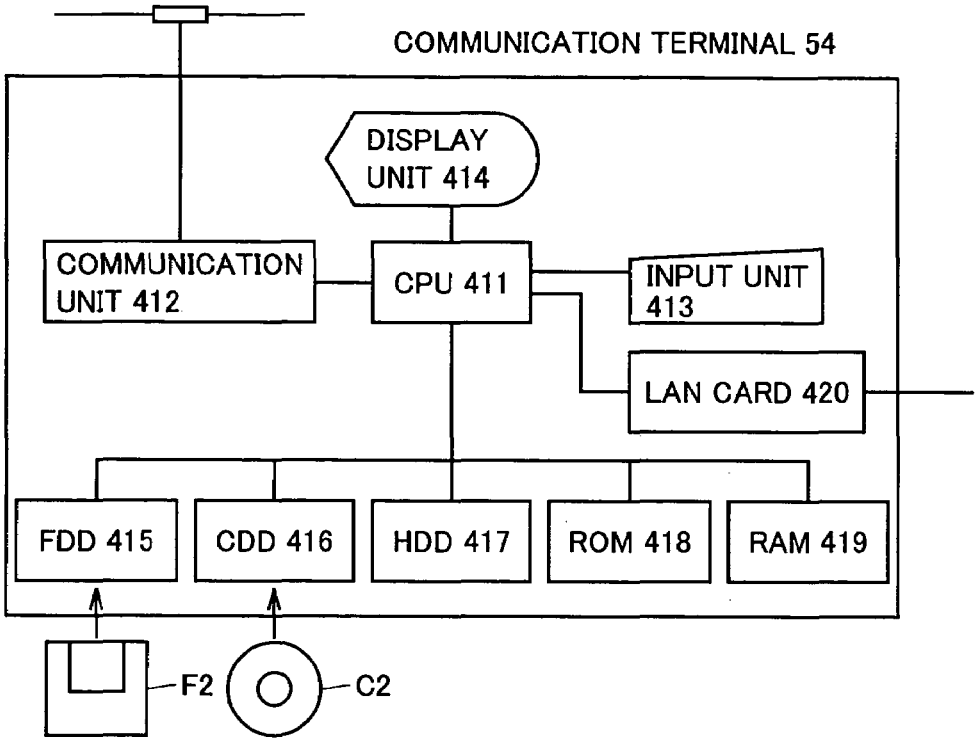
FIG. 3 is a block diagram showing a configuration of a communication terminal 54 in FIG. 1.

FIG. 3 is a block diagram showing a configuration of communication terminal 54 in FIG. 1.

Referring to FIG. 3, communication terminal 54 includes a CPU 411 controlling the entire device, a display unit 414, a communication unit 412 for communicating with external devices, a LAN (Local Area Network) card 420 for connection to the network, an input unit 413 including a keyboard and a mouse for example, a flexible disk drive 415, a CD-ROM drive 416, a hard disk drive 417, a ROM 418 and a RAM 419.

A program for driving CPU (computer) 411 can be recorded on such a recording medium as flexible disk (F2) or CD-ROM (C2). This program is transmitted from the recording medium to the RAM or another recording medium to be recorded thereon. Here, the program may be recorded on such a recording medium as hard disk, ROM, RAM, or memory card to be supplied to a user. Alternatively, the program may be downloaded via the Internet from an external site onto the device to be executed.

A description is now given below of the characteristic configuration and effects of the image forming apparatus.

Image forming apparatus 50 with the configuration as shown in FIG. 2 has a power saving mode by which power consumption can be lowered. When no transmission nor handling of a print job is done by a user for a predetermined period of time, the apparatus makes a transition to the power saving mode for reducing power consumption.

In the power saving mode, it is necessary that electric power is fed to only the required minimum elements. Even if power supply to most of the elements of the apparatus is stopped, the status immediately before the power saving mode can be stored in interface unit 7 or communication terminal 54 and then the status can be reported to the service center in the power saving mode. The conventional techniques, however, cannot report to the service center about sensor information as to any malfunction detected by the sensor in a power saving mode.

The image forming apparatus in this embodiment thus employs the power supply configuration as shown in FIG. 2.

Specifically, the image forming apparatus includes a first power supply 1 supplying electric power for allowing prints to be produced, by supplying electric power through a power-supply line 60 to scanner unit 3, image processing unit 6, printer block 8 and printing unit 15 as well as a second power supply 2 supplying electric power through a power-supply line 61 to CPU 20 of printer block 8, sensors 9, 10, 11, 12 and 13 and interface unit 7.

Here, CPU 20 of printer block 8 refers to minimum elements required for operation of the CPU, namely such elements as CPU, oscillator and ROM storing a program.

Through a control line 39 controlling the first power supply 1 and a control line 70 controlling the second power supply 2, CPU 20 turns on and turns off the power supplies each.

In the power saving mode, CPU 20 turns off the first power supply 1 through control line 39 while the second power supply 2 remains turned on. Therefore, interface unit 7 can communicate with network 36 and CPU 20 can transmit respective results of detection by sensors 9, 10, 11, 12 and 13, from interface 7 via network 36 to communication terminal 54.

The results of detection by respective sensors 9, 10, 11, 12 and 13 represent sensor values and MIB information as to a trouble state for example determined from the sensor values. The first power supply 1 and the second power supply 2 can be turned on and off by manipulation of a main switch (not shown) of the image forming apparatus. The above-described power supply configuration and the power feeding manner can be employed to detect values of respective sensors and report, all the time, the values to the service center via the Internet even in the power saving mode.

Then, when any abnormality is found from detection of the sensitivity of a sensor, it can be reported to the service sensor that repair is necessary even in the power saving mode so that the apparatus can immediately be repaired.

When the image forming apparatus is in the power saving mode, information provided to communication terminal 54 connected to network 36 as well is insufficient. In the power saving mode in which power supply to most elements of the apparatus is turned off, the status of the apparatus before the power saving mode is stored in interface unit 7 and the status is transmitted as MIB information. Alternatively, the MIB information may be stored in storage unit 417, which is a hard disk, of communication terminal 54 and then the information may be transmitted to the service center.

A specific example of the status of the apparatus before the power saving mode that is stored in interface unit 7 is information about the temperature of the fusing roller. With the transition to the power saving mode, the fusing roller gradually cools since its heat source is cut off. The temperature of the fusing roller when an instruction to form an image is given is preferably higher in order to shorten the recovery time as much as possible. Here, the recovery time refers to time to be taken for the roller to return to the temperature at which image formation is possible.

Figure 4:
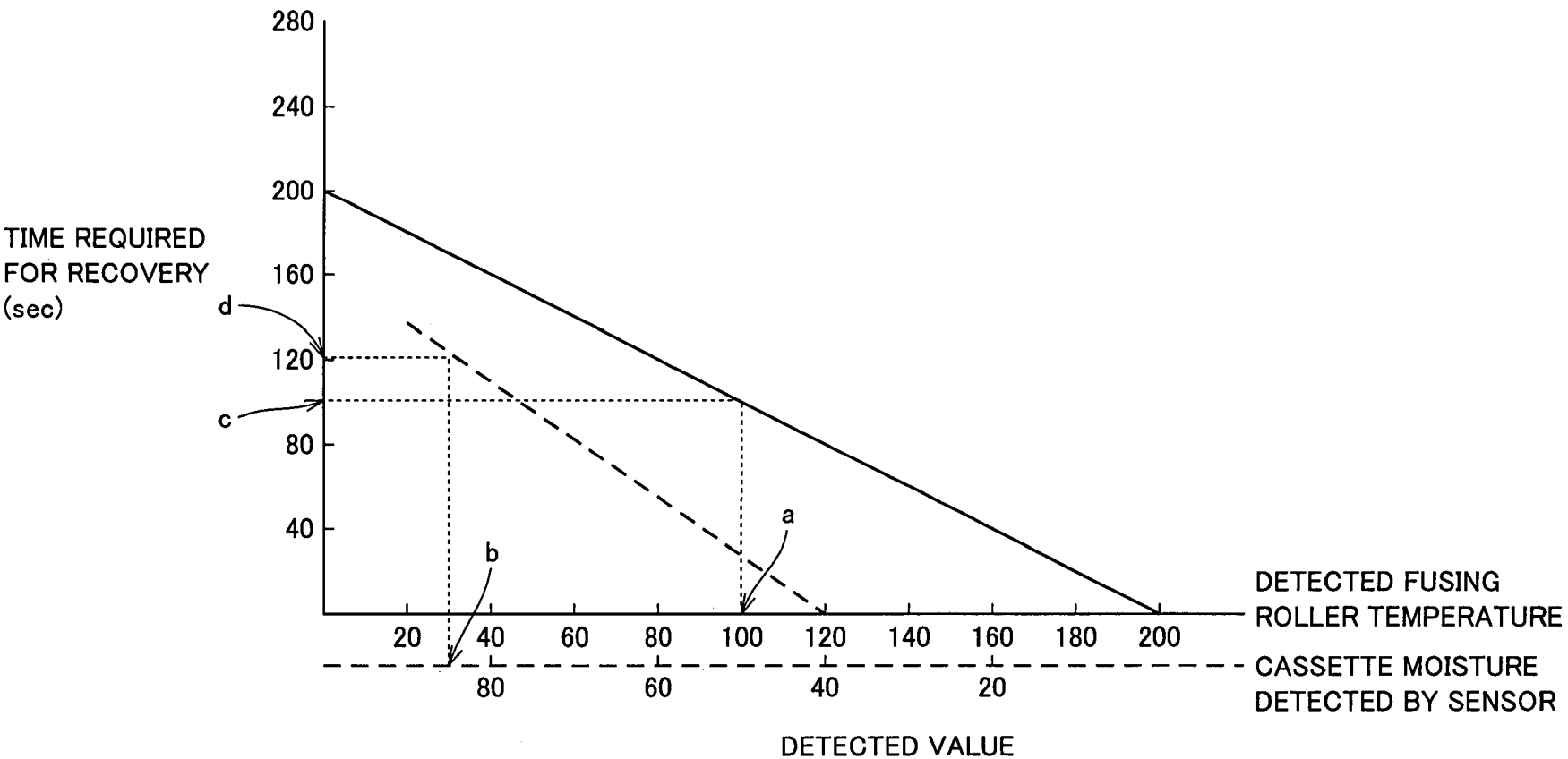
FIG. 4 shows relations between the temperature of a fusing roller, paper moisture and recovery time.

FIG. 4 shows relations between the temperature of the fusing roller, the moisture of paper and the recovery time.

Referring to FIG. 4, the horizontal axis of the solid line indicates the detected temperature of the fusing roller and the horizontal axis of the dotted line indicates the moisture detected by the cassette moisture sensor. The vertical axis indicates the time (in seconds) required for recovery. Further, the solid line within the graph represents a relation between the detected temperature of the fusing roller and the recovery time and the dotted line in the graph represents the moisture detected by the cassette moisture sensor and the recovery time.

The relation between the detected temperature of the fusing roller and the recovery time as indicated by the solid line in FIG. 4 may be represented by a table or a function expression to be stored in interface unit 7. Then, information about the recovery time that is derived from the information about the successively changing temperature of the fusing roller can be provided to communication terminal 54, and accordingly communication terminal 54 can determine which of the image forming apparatuses should currently be used for completing a job in the shortest period of time.

Further, if any successive change in temperature of the fusing roller, which is different from the one indicated by the solid line in FIG. 4, is detected, it can be detected that there occurs abnormality in sensitivity of fusing roller temperature sensor 9. Specifically, if the thermistor sensor has abnormality, the sensor does not detect any decrease in temperature even when power supply to the fusing unit is turned off and thus abnormality in fusing roller temperature sensor 9 can be detected. A value indicated by fusing roller temperature sensor 9 is transmitted from interface unit 7 to communication terminal 54. Accordingly, communication terminal 54 determines that there occurs abnormality in fusing roller temperature sensor 9 to inform the service center of the abnormality of fusing roller temperature sensor 9.

The determination as to the abnormality of fusing roller temperature sensor 9 may be done by interface unit 7 instead of communication terminal 54 to inform the communication terminal of the abnormality in fusing roller temperature sensor 9.

A description is given now of an example of determination by communication terminal 54 as to which of the image forming apparatuses should currently be used for finishing a job in the shortest period of time.

For this determination, for example, paper moisture sensor 12 is used. The moisture of paper must have a certain level or lower. If not, a transfer defect occurs when a toner image formed on the photoreceptor is transferred to a sheet of paper. In such a case, the density of an image to be output from the image forming apparatus is not the proper one to be reproduced.

In usual, a heater for dehumidification is mounted on a cassette from which sheets of paper are fed, in order to prevent the moisture from exceeding a certain level. However, if power supply to the humidifying heater of the cassette is turned off in the power saving mode for decreasing power consumption as much as possible, moisture sensor 12 mounted on the cassette would show a gradually increasing moisture if the ambient moisture of the apparatus is high. Depending on the environment of the apparatus and the time passed from transition to the power saving mode, image formation could not be started, when the apparatus returns from the power saving mode, until the dehumidifying heater sufficiently lowers the moisture in the cassette.

As mentioned above, the dotted line in FIG. 4 represents the relation between the detected moisture of paper and the recovery time. The relation represented by this dotted line may be stored in interface unit 7 or communication terminal 54 in the form of values in a table or a function expression, so that information about the recovery time derived from information about the paper moisture which successively changes can be obtained.

Regarding the remaining amount of paper, the remaining paper amount immediately before the power saving mode does not decrease since no paper is used in the power saving mode. If, however, a managing person for example replenishes the apparatus with some sheets of paper, the information about this replenishment must be provided to communication terminal 54. If not, it could erroneously be determined that sheets of paper are insufficient for finishing a given job.

Regarding the sensitivity of the photoreceptor, since the photoreceptor has temperature characteristics, the sensitivity of the photoreceptor is corrected by image stabilization when a certain temperature difference arises, in order to ensure tone reproduction of an image. Specifically, a certain tone pattern is formed on the photoreceptor, density thereof is read and an appropriate tone correction curve for example is determined. In particular, a color printer requires image stabilization for four colors, resulting in a time consumed for image stabilization that is four times as long as the time of a monochrome printer.

If a change in temperature of the photoreceptor becomes equal to or greater than a predetermined temperature difference, the time required for image stabilization should be considered in determining the recovery time. In other words, the recovery time informed to communication terminal 54 should be determined in consideration of the time for this image stabilization.

Communication terminal 54 can thus obtain information about the recovery time derived from information about the paper moisture, information about the remaining amount of paper and the time required for image stabilization, for example, and then determine, from the obtained information, which of the image forming apparatuses should currently be used for finishing a given job in the shortest period of time.

In this embodiment, the image forming apparatus is configured to save electric power as much as possible in the power saving mode and to allow communication terminal 54 to obtain from the network the required information about the apparatus in the power saving mode. The configuration is now described in connection with FIG. 2.

In transition to power saving mode, CPU 20 turns off the first power supply 1 to effect power saving.

CPU 20 of printer block 8 and interface unit 7 are connected by communication line 35 so that interface unit 7 receives through communication line 35 respective values indicated by sensors 9, 10, 11, 12 and 13 that are detected by CPU 20 of printer block 8.

The values indicated respectively by sensors 9, 10, 11, 12 and 13 that are received by interface unit 7 are transmitted to communication terminal 54 as requested by communication terminal 54. However, even if information about the temperature of the fusing roller is provided, the recovery time to be taken at each fusing roller temperature cannot be determined since the recovery time required at each fusing roller temperature is determined depending on characteristics specific to the image forming apparatus such as power of the fusing heater of each printer and thermal capacity of the fusing roller.

In other words, it is necessary to determine the time required for recovery from each value of the sensor and inform communication terminal 54 of the time required for recovery (recovery time).

The recovery time may be informed by one of the following two methods.

According to a first method, CPU 20 of printer block 8 determines the recovery time through calculation using respective results of detection by the sensors.

According to a second method, CPU 20 of printer block 8 transfers respective results of detection by the sensors to communication terminal 54 via interface unit 7, and communication terminal 54 then determines the recovery time by means of a table that is stored in advance in communication terminal 54 and associates the results of detection by the sensors and the recovery time.

The method is described below of calculating the recovery time that is common to the above-described two methods.

Referring to the relations shown in FIG. 4 between the value indicated by the fusing roller temperature sensor, the value indicated by the moisture sensor and the recovery time, when the temperature detected by the sensor is 100° C. (point a), the recovery time is 90 seconds (point c). When the moisture detected by the paper moisture sensor is 95% (point b), the recovery time is 120 seconds (point d). Since the recovery time determined by the value indicated by the moisture sensor is longer then the recovery time determined by the value indicated by the fusing roller temperature sensor, 120 seconds derived from the moisture sensor value is determined here as the recovery time.

Consideration is then given to a change in sensitivity of the photoreceptor in determining the recovery time. The temperature of the photoreceptor that is detected with a predetermined frequency is compared with the temperature when the last image stabilization is finished and, if the difference in temperature exceeds 10° C., an image stabilization flag is set. This flag indicates that an image stabilization is necessary.

For example, if 200 seconds is required for obtaining image stabilization data, the recovery time of 200 seconds required for obtaining the image stabilization data is longer than the recovery time of 120 seconds calculated from the temperature indicated by the fusing roller temperature sensor and the moisture indicated by the paper moisture sensor. Then, the recovery time is finally determined as 200 seconds. This recovery time is displayed on communication terminal 54 on the network.

Regarding information about whether or not a required amount of paper is ready, a remaining amount of paper is transferred constantly by CPU 20 of printer block 8 to communication terminal 54 on the network. Communication terminal 54 then compares the number of sheets required for a printing job to be done with the remaining amount of paper. If the remaining amount of paper is insufficient for the job, which may be reported to a communication terminal (not shown) different from communication terminal 54 connected to the network 36.

When various image forming apparatuses 50, 51, 52 and 53 are connected on the network as shown in FIG. 1, it is automatically determined which of the image forming apparatuses should be selected for doing printing in the shortest period of time, according to a method described below. This method is followed through execution of a program stored in the communication terminal.

Communication terminal 54 requests each image forming apparatus to provide MIB information. Then, communication terminal 54 receives from each of the image forming apparatuses, when communication terminal 54 is to send a print job, data about the status of the apparatus, image forming speed, recovery time and remaining amount of paper, as MIB information. Based on this information, communication terminal 54 selects an image forming apparatus for outputting a print, and then transmits the print job thereto.

If image forming apparatus 50 is in power saving mode when the print job is transmitted to image forming apparatus 50, CPU 20 shown in FIG. 1 turns on the first power supply.

Figures 5, 6:
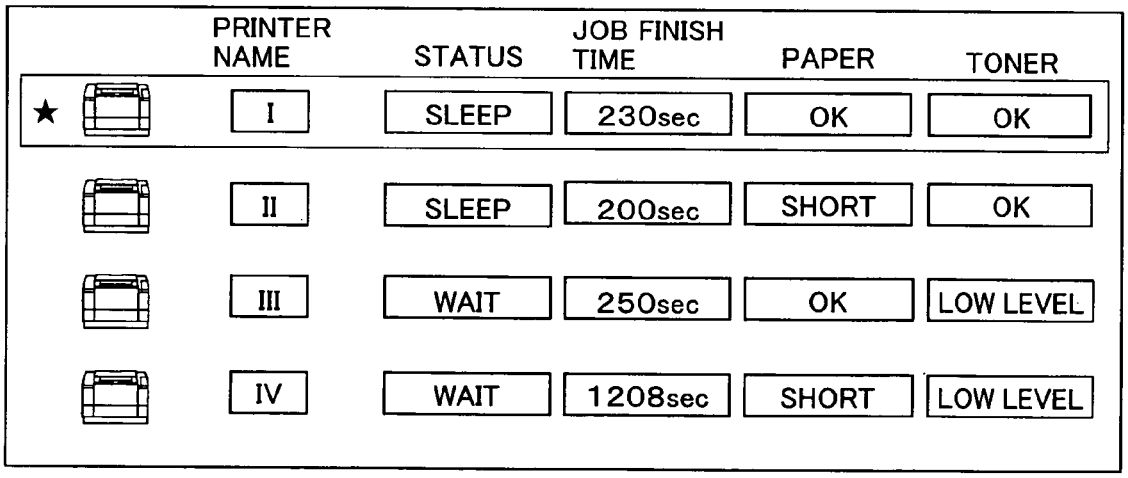
FIG. 5 shows specific examples of MIB information obtained by the communication terminal 54 and the time to be taken for completing image formation that is calculated from the MIB information.
FIG. 6 shows a specific example of a screen display based on the information shown in FIG. 5.

FIG. 5 shows specific examples of MIB information obtained by communication terminal 54 as well as the time to be consumed for completing image formation that is calculated finally from the MIB information.

In FIG. 5, MIB information of each of a plurality of image forming apparatuses I–IV on the network is shown.

It is supposed here that the number of sheets of paper required for a print job is 100 sheets. The final time required for completing image formation (job finish time) is calculated as the sum of the recovery time and the time required for image formation (first print time+printing speed×the number of prints to be made) of the image forming apparatus. Based on this information, indications are displayed as shown in FIG. 6 on display unit 414 of communication terminal 54. It is thus clearly seen from the display which of the image forming apparatuses should be selected.

Moreover, from the display shown in FIG. 6, an image forming apparatus can be selected to which supply of sheets is unnecessary during the printing process. This selection may automatically be made.

"Printer Name" in FIG. 6 refers to image forming apparatuses 50, 51, 52 and 53 shown in FIG. 1. The image forming apparatuses in "Sleep" status as shown in the column indicated by "Status" in FIG. 6 are in power saving mode. The image forming apparatuses in "Wait" status are returning from power saving mode. The image forming apparatuses with "Low Level" as shown in the "Toner" column in FIG. 6 is running short of toner.

This embodiment as discussed above provides effects that a change in status of the image forming apparatus in power saving mode can be detected so that any trouble of the image forming apparatus can immediately be reported to the service center, and a change in sensitivity of the sensor (detecting means) itself can also be detected so that any deterioration or abnormality of the sensor itself can immediately be reported to the service center.

This embodiment also provides an effect that the status of the image forming apparatus in power saving mode can be checked from the communication terminal so that the image forming apparatus in power saving mode can be selected by the communication terminal for use as an apparatus from which prints are output.

Further, this embodiment provides an effect that, since the temperature of the fusing roller of the image forming apparatus in power saving mode can be checked from the communication terminal, the communication terminal can determine whether or not a copying operation can immediately be started when the communication terminal transmits a print job to the image forming apparatus. Accordingly, it can be determined which of the image forming apparatuses on the network is ready, i.e., the temperature of the fusing roller attains the temperature available for printing, so that an image forming apparatus that becomes ready for copy in the shortest period of time can be selected.

Moreover, an effect of this embodiment is that, since the moisture of paper in the image forming apparatus in power saving mode can be checked from the communication terminal, the communication terminal can determine whether or not a copying operation can be started when the communication terminal transmits a print job to the image forming apparatus. Therefore, it is possible to identify one of the image forming apparatuses that becomes ready for printing in the shortest period of time, i.e., the moisture of paper reaches a moisture available for printing, and thus an image forming apparatus that becomes ready for copying in the shortest period of time can be selected.

Further, an effect of this embodiment is that, the communication terminal can identify image forming apparatuses including the one(s) in power saving mode that contain a stock of paper sufficient to finish a given print job.

In addition, since the sensitivity of the photoreceptor of the image forming apparatus in power saving mode can be checked from the communication terminal, the communication terminal can determine whether or not a copying operation can immediately be started when the communication terminal transmits a print job to the image forming apparatus. Then, an image forming apparatus among the image forming apparatuses on the network can be identified that has its photoreceptor attaining a sensitivity available for printing in the shortest period of time. Accordingly, an image forming apparatus which becomes ready for a copying operation in the shortest period of time can be selected.

[Second Embodiment]

Figure 7:
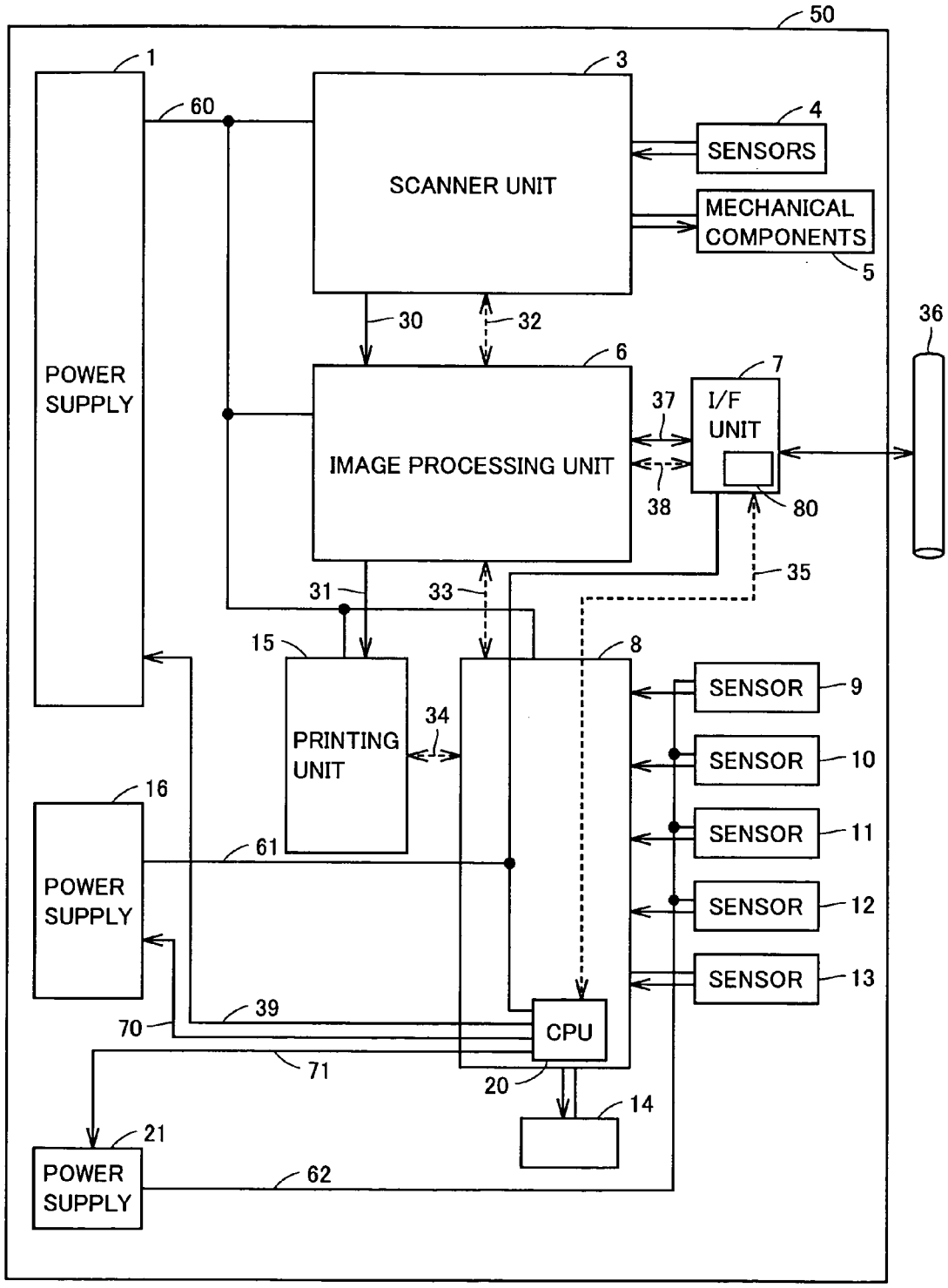
FIGS. 7, 8 and 9 show respective configurations of image forming apparatuses according to second, third and fourth embodiments respectively of the present invention.

FIG. 7 shows a configuration of an image forming apparatus according to a second embodiment of the present invention. This apparatus can achieve power saving to a greater degree as compared with the apparatus of the first embodiment.

Referring to FIG. 7, like components are denoted by like reference characters with respect to the apparatus configuration shown in FIG. 2.

In this embodiment, instead of the second power supply 2 in FIG. 2, a third power supply 21 is employed for supplying electric power via a power-supply line 62 to sensors 9–13 only. In addition, a fourth power supply 16 is provided for supplying electric power via a power-supply line 61 to interface unit 7 and CPU 20 only.

The first power supply 1, the third power supply 21 and the fourth power supply 16 can be turned on and off by manipulation of a main switch (not shown).

CPU 20 controls the third power supply 21 through a control line 71 and controls the fourth power supply 16 through a control line 70 for turning on and off the power supplies each.

When the apparatus enters power saving mode, the first power supply 1 and the third power supply 21 are turned off. During the power saving mode, only the fourth power supply 16 is turned on and the first and third power supplies are then turned on by an instruction from CPU 20. The power supplies are each turned on by manipulation of the main switch (not shown).

It is unnecessary that respective outputs of the sensors are detected regularly. Therefore, the sensors may be powered only when communication terminal 54 requests MIB information. In the power saving mode, the third power supply 21 may thus be turned off. Therefore, CPU 20 turns on the third power supply 21 upon a request for the MIB information from communication terminal 54 in the power saving mode.

With the configuration shown in FIG. 7, power may further be saved by storing respective values indicated by the sensors in storage unit 80 of interface unit 7 when the third power supply 21 is turned off and transmitting any of the stored sensor values at request of communication terminal 54.

If a result of detection by a sensor changes with time after the power supply is turned off, like the temperature of the fusing roller, the following method may be used to address this situation. The temperature of the fusing roller begins to decrease with time after the first power supply 1 is turned off. The rate at which the temperature decreases varies depending on the ambient temperature of the place where the image forming apparatus 50–53 is provided. Therefore, a plurality of functions for certain ambient temperatures are stored in storage unit 80. Here, as ambient temperatures, values indicated by photoreceptor temperature sensor 11 are stored in storage unit 80.

When the first power supply 1 is turned off, the temperature of the fusing roller is detected by sensor 9 and stored in storage unit 80 while clocking is started by CPU 20. At a request for MIB information from communication terminal 54, a function stored in storage unit 80 is selected based on the value indicated by photoreceptor temperature sensor 11. Then, from the time clocked by CPU 20 and the sensor value of fusing roller temperature sensor 9 stored in storage unit 80, the actual temperature of the fusing roller is determined and transmitted to communication terminal 54.

When the above-described method is used, it is unnecessary to turn on the third power supply 21 in the power saving mode. In other words, the sensors can be powered off until a request from the communication terminal is given, so that power consumption can be reduced. Moreover, without power supply to the sensors in the power saving mode, the result of detection by the sensor that varies with time can be reported to the communication terminal in power saving mode.

[Third Embodiment]

Figure 8:
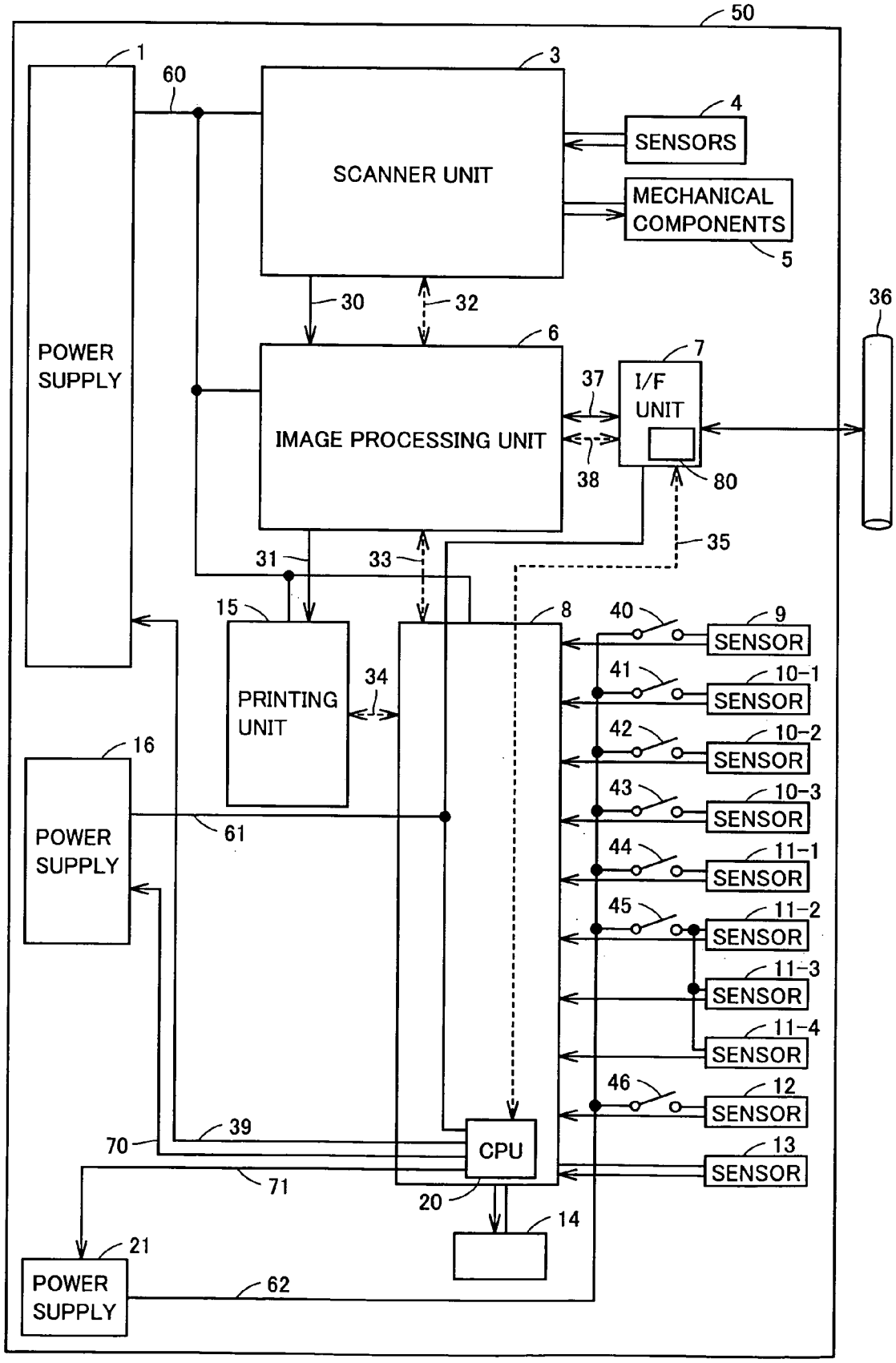

FIG. 8 shows a configuration of an image forming apparatus that can save power to a far greater degree.

This image forming apparatus includes, similarly to the image forming apparatus shown in FIG. 7, the first power supply 1, the third power supply 21 and the fourth power supply 16. The apparatus in FIG. 8 has, however, sensors 10-1 to 10-3 as well as sensors 11-1 to 11-4 instead of sensors 10 and 11, and individual sensor switches 40–46 for switching the energized state of each sensor.

Sensors 10-1 to 10-3 detect respective remaining amounts of paper in respective cassettes of different sheet sizes. Sensors 11-1-11-4 detect respective temperatures of photoreceptors for colors Y, M, C and K respectively. Power supply to the sensors is controlled by individual sensor switches 40–46 respectively.

At a request for MIB information from communication terminal 54, only the switch corresponding to the requested sensor value is turned on according to an instruction from CPU 20. Thus, interface unit 7 obtains the required MIB information and the information is transmitted to communication terminal 54 with the minimum power.

Depending on the type of an image formation job, information from all of sensors 9–13 may be unnecessary.

Suppose that communication terminal 54 on the network is to instruct to make monochrome prints on 100 sheets of paper of A4Y in size. Then, communication terminal 54 requests the image forming apparatuses connected on the network to provide MIB information necessary for determining which of the image forming apparatuses can first finish image formation.

In this case, information about the remaining amount of sheets in the tray for A4Y paper is necessary. Then, only the result of detection by A4Y paper sensor 10-1 is required so that power supply to the other remaining paper amount sensors except for the A4Y paper amount sensor is unnecessary. Accordingly, printer block 8 turns on switch 41 only for energizing sensor 10-1 to obtain the remaining paper amount of paper which is then transmitted onto the network. In other words, switches 42 and 43 provided to the power supply for sensors 10-2 and 10-3 are still off and thus sensors 10-2 and 10-3 are still powered off.

Suppose next that a monochrome image is to be printed. In this case, only a photoreceptor for black is used. Therefore, temperature correction is not done for photoreceptors for yellow, cyan and magenta respectively. Accordingly, only energization switch 44 for the black photoreceptor temperature sensor is turned on while energization switch 45 for the color photoreceptor temperature sensor is left in off state. Only the information about the temperature of the black photoreceptor is thus obtained and transmitted to the network.

As discussed above, electric power may be supplied to only the minimum sensor(s) according to a request from communication terminal 54 so that power consumption can be optimized. In other words, when a request is given from the communication terminal, there are sensors that are not energized and thus power consumption can be reduced.

[Fourth Embodiment]

The third power supply 21 in the power supply arrangement shown in FIG. 8 must have a current capacity sufficient for supplying electric power to all sensors to be energized.

Usually, the AC-to-DC conversion efficiency of the power supply is designed to be maximum with a current around the rated current. If a limited number of sensors only are made on, a slight amount of current is consumed with respect to the rated current, resulting in a considerable deterioration in conversion efficiency of the power supply.

Figure 9:
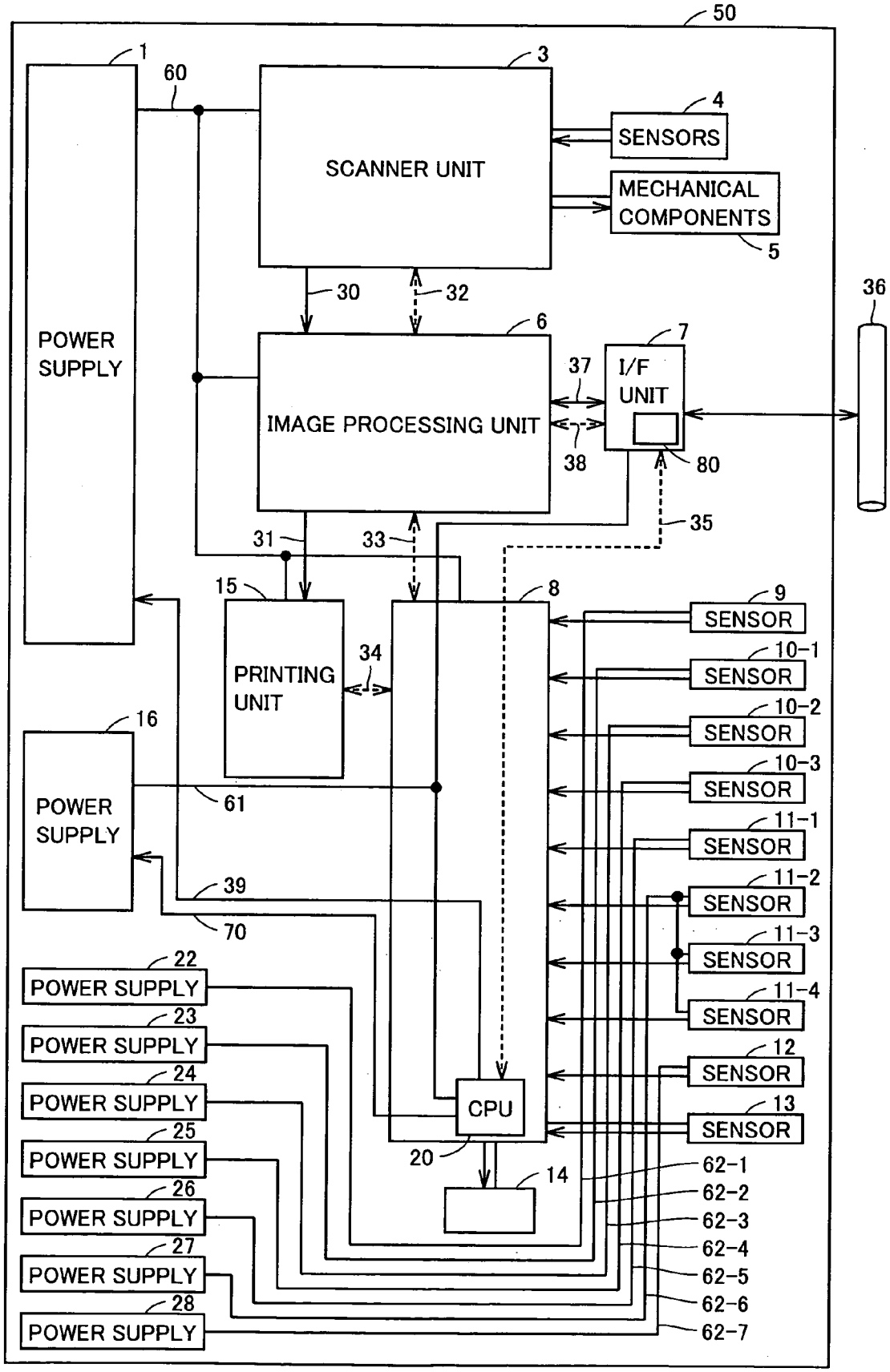

Then, as shown in FIG. 9, instead of switches (40–46 shown in FIG. 8) provided to respective sensors, individual power supplies 22–28 that can be turned on and off by control lines (not shown) of CPU 20 are provided for respective sensors.

At a request from communication terminal 54, only the power supplies for energizing necessary sensors are turned on by power supply lines 62-1 to 62-7 so as to improve the conversion efficiency of the power supplies. In this way, power consumed upon a request from communication terminal 54 can be reduced.

According to the above-described embodiments, an image forming apparatus without interference with use of the apparatus can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a printer forming an image on a printing medium;

a first power supply supplying electric power to said printer;

an interface communicating with an external communication terminal;

a detector detecting a change in status in said image forming apparatus;

a second power supply supplying electric power to said interface and said detector; and a controller, said controller being provided to control said first power supply and said second power supply and while said first power supply is turned off and said second power supply is turned on, said controller transmitting a result of detection by said detector to said communication terminal via a network.

2. The image forming apparatus according to claim 1, wherein said controller transmits said result of detection upon request from said communication terminal.

3. The image forming apparatus according to claim 1, wherein said controller is provided to turn on said first power supply upon receiving a print job from said communication terminal.

4. The image forming apparatus according to claim 1, wherein said printer includes a photoreceptor forming an electrostatic latent image, a development unit forming a toner image on said photoreceptor, a transfer unit transferring said toner image onto the printing medium, and a fuser fixing said toner image on said printing medium, and said detector includes at least one of a fusing temperature detector detecting a fusing temperature, a moisture detector detecting moisture of said printing medium, a remaining-amount detector detecting a remaining amount of said printing medium, a photoreceptor sensitivity detector detecting sensitivity of said photoreceptor, and a transport position detector detecting a position where said printing medium is transported.

5. The image forming apparatus according to claim 1, wherein said detector detects a plurality of statuses and said detector includes a plurality of detector units provided respectively for said statuses.

6. The image forming apparatus according to claim 5, wherein said plurality of detector units are individually switched between an energized state and a deenergized state.

7. The image forming apparatus according to claim 6, wherein said second power supply includes power supply units provided respectively for said plurality of detector units.

8. The image forming apparatus according to claim 6, wherein said second power supply further includes switches respectively switching said plurality of detector units between the energized state and the deenergized state.

9. An image forming apparatus comprising:

a printer forming an image on a printing medium;

a first power supply supplying electric power to said printer;

an interface communicating with an external communication terminal;

a detector detecting a change in status in said image forming apparatus;

a second power supply supplying electric power to said detector;

a third power supply supplying electric power to said interface; and a controller, said controller being provided to control said first power supply, said second power supply and said third power supply, and while said first power supply and said second power supply are turned off and said third power supply is turned on, said controller turning on said second power supply upon request from said communication terminal.

10. The image forming apparatus according to claim 9, further comprising a storage unit storing a result of detection by said detector, wherein said controller stores said result of detection in said storage unit when said second power supply is turned off and transmits said result of detection stored in said storage unit upon request from said communication terminal.

11. The image forming apparatus according to claim 10, further comprising a clock starting clocking after said first power supply is turned off, wherein upon request from said communication terminal, a value to be replied upon the request is determined based on said result of detection stored in said storage unit and time clocked by said clock.

12. A method of controlling an image forming apparatus, said image forming apparatus including:

a printer forming an image on a printing medium;

a first power supply supplying electric power to said printer; an interface communicating with an external communication terminal;

a detector detecting a change in status in said image forming apparatus;

a second power supply supplying electric power to said interface and said detector; and a controller controlling said first power supply and said second power supply, and said method comprising:

a power-supply control step of making a transition of said first power supply from a turned-on state to a turned-off state;

a detection step of detecting by said detector a change in status in said image forming apparatus; and a transmission step of transmitting a result of detection to the communication terminal.

13. The method of controlling an image forming apparatus according to claim 12, wherein in said transmission step, the result of detection is transmitted upon request from said communication terminal.

14. The method of controlling an image forming apparatus according to claim 12, further comprising the step of turning on said first power supply upon receiving a print job from said communication terminal.

15. The method of controlling an image forming apparatus according to claim 12, wherein said printer includes;

a photoreceptor forming an electrostatic latent image, a development unit forming a toner image on said photoreceptor, a transfer unit transferring said toner image onto the printing medium, and a fuser fixing said toner image on said printing medium, and said detector detects at least one of temperature of a fusing roller, moisture of said printing medium, remaining amount of said printing medium, sensitivity of said photoreceptor and position where said printing medium is transported.

16. The method of controlling an image forming apparatus according to claim 12, wherein a plurality of statuses in said image forming apparatus are detected, and in said detection step, a plurality of detector units provided respectively for said plurality of statuses detect a change in status.

17. The method of controlling an image forming apparatus according to claim 12, wherein a plurality of statuses in said image forming apparatus are detected, and, said method further comprises the steps of:

detecting a change in status by a plurality of detector units provided respectively for said plurality of statuses; and selecting a detector unit from said plurality of detector units according to a request from said communication terminal and energizing the selected detector unit.

18. The method of controlling an image forming apparatus according to claim 12, wherein said second power supply includes a power supply supplying electric power to said detector and a power supply supplying electric power to said interface, and said method further comprises the step of, while said first power supply and said power supply to said detector are turned off and said power supply to said interface is turned on, turning on said power supply to said detector by said controller upon request from said communication terminal.

19. The method of controlling an image forming apparatus according to claim 18, further comprising the steps of:

storing the result of detection in a storage unit provided to said image forming apparatus when the power supply to said detector is turned off; and transmitting the result of detection stored in said storage unit upon request from said communication terminal.

20. The method of controlling an image forming apparatus according to claim 19, further comprising the steps of:

starting clocking after said first power supply is turned off; and determining, upon request from said communication terminal, a value to be transmitted to said communication terminal based on the result of detection stored in said storage unit and time obtained by clocking.

* * * * *